United States Patent [19]

Gaudette

[11] 4,085,958

[45] Apr. 25, 1978

[54] FLUE LINER HANDLING DEVICE

[76] Inventor: Robert Gaudette, 35 Granite St., Biddeford, Me. 04005

[21] Appl. No.: 783,068

[22] Filed: Mar. 30, 1977

[51] Int. Cl.[2] ..... B66C 1/44

[52] U.S. Cl. ..... 294/97

[58] Field of Search ..... 294/97, 95, 93, 94, 294/79, 80, 86.24, 86.25, 87.18; 29/237

[56] References Cited

U.S. PATENT DOCUMENTS

| | | | |
|---|---|---|---|
| 2,706,658 | 4/1955 | Jewell | 294/97 |
| 3,469,298 | 9/1969 | Pizzagalli | 294/97 |

*Primary Examiner*—James B. Marbert
*Attorney, Agent, or Firm*—William Nitkin

[57] ABSTRACT

A device for the raising and lowering of a chimney flue liner pipe within a chimney comprised of a wedge element affixed by a hinge member to a release element, the wedge element having a wedge element release rope aperture and a wedge element lowering rope aperture defined therein, and the release element having a release element lowering rope aperture and a release element release rope aperture defined therein; a release rope passing through the wedge element release rope aperture and the release element release rope aperture and affixed to the wedge element, and a lowering rope passing through the release element lowering rope aperture and then through the wedge element lowering rope aperture and affixed to the wedge element.

4 Claims, 3 Drawing Figures

FLUE LINER HANDLING DEVICE

BACKGROUND OF THE INVENTION

The device of this invention relates to pipe handling devices and more particularly relates to a device for the raising and lowering of ceramic pipe or chimney flue liners.

Due to the high cost of fossil fuels, many homeowners currently wish to utilize fireplaces within their homes for the burning of wood as an additional source of heat. If these home fireplaces are many years old or in a deteriorated or otherwise clogged and dirty condition, the lighting of a fire therein could cause an extreme fire hazard to the occupants of the building. In order to safely use such fireplaces, many individuals retain brick masons to reline the interior of the fireplace flue by the placement therein of chimney flue liner pipes. In the past it has often been necessary to completely tear down the chimney for the insertion of these pipes and to rebuild it which procedure can be expensive. Therefore it is an object of this invention to provide a device which is extremely simple to use and very economical in construction for the lowering of the flue liner pipes through the top of the chimney without the necessity of dismantling all the brickwork of the chimney.

SUMMARY

It is an object of this invention to provide a device for the raising and lowering of flue liner pipes and tubing from the open top of a chimney to positions within the chimney and then removing the device once the flue liner pipes are cemented in place or suitably joined by whatever means of joining are to be utilized.

Disclosed is a device having a lowering rope which is used to wedge the device within the chimney flue liner pipe and a release rope which is used to release the device once the chimney flue liner is in place within the chimney.

The device is comprised of two elements hinged at one end, the first being a release element and the second being a wedge element. The release element has two apertures defined within it, namely a release element release rope aperture and a release element lowering rope aperture. The wedge element also has two apertures defined within it, namely a wedge element release rope aperture and a wedge element lowering rope aperture. The lowering rope passes through the release element lowering rope aperture in the release element and then through the wedge element lowering rope aperture in the wedge element and is fastened thereto at its bottom by a knot or other equivalent fastening means. The release rope passes through the release element release rope aperture in the release element and then through the wedge element release rope aperture in the wedge element and is fastened thereto at the bottom of the wedge element by a knot or other fastening means.

When using the device of this invention, one holds the release rope and lowers the device into the flue liner pipe and then pulls on the lowering rope which causes the wedge element to move to a more horizontal position thereby wedging it against opposite sides of the pipe. One then can lift and lower the entire pipe down the chimney until the pipe is in position. Then by pulling the release rope, one causes the wedge element to move out of its more horizontal position into a more angular position within the chimney. The device is thereby released and can be raised out of the chimney pipe without any further adjustments.

Although the device is most useful in the application cited above, it can also be used for other applications where other piping must be raised or lowered.

The device of this invention will become clearer when reference is made to the following drawings and descriptions thereof.

DESCRIPTION OF THE PREFERRED EMBODIMENT

Figure 1:
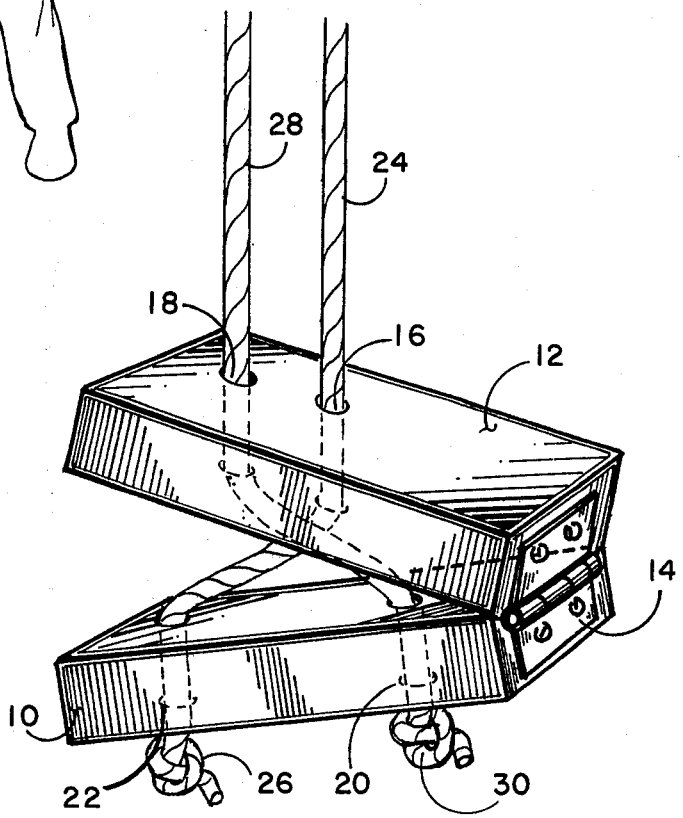
FIG. 1 illustrates a perspective view of the device of this invention.

FIG. 1 illustrates a perspective view of the device of this invention showing the device being comprised of wedge element 10 and release element 12 hinged at one end by hinge member 14. Near the center of release element 12 is release element lowering rope aperture 16 and near the opposite end from hinge member 14 of the release element 12 is release element release rope aperture 18. Wedge element 10 contains wedge element release rope aperture 20 closest to hinge member 14 but centrally located therein, and farthest from hinge member 14 is wedge element lowering rope aperture 22 of wedge element 10. Lowering rope 24, which should be of a sufficient length to lower the flue liner pipe down the chimney to its resting position, passes through release element lowering rope aperture 16 in release element 12 and then passes through wedge element lowering rope aperture 22 in wedge element 10. Lowering rope 24 is then fastened at the bottom of wedge element lowering rope aperture 22 by knot 26 or by any equivalent fastening means, the knot not being able to pass back through wedge element lowering rope aperture 22. Release rope 28 should be of a similar length to the length of lowering rope 24. Release rope 28 passes through release element release rope aperture 18 of release element 12 and then passes through wedge element release rope aperture 20 of wedge element 10, at the base of which it is tied in knot 30 or fastened thereto be equivalent means, the knot not being able to pass back through wedge element release rope aperture 20.

Figure 2:
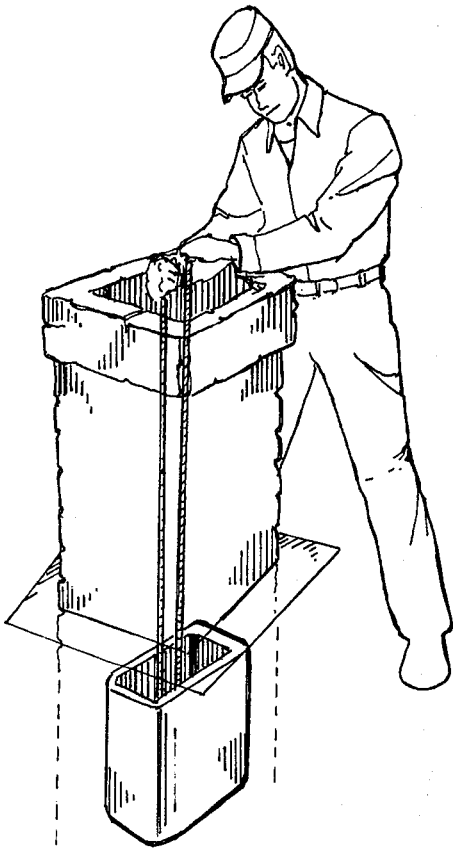
FIG. 2 illustrates an individual lowering a flue liner pipe through the top opening of a chimney using the device of this invention.
Figure 3:
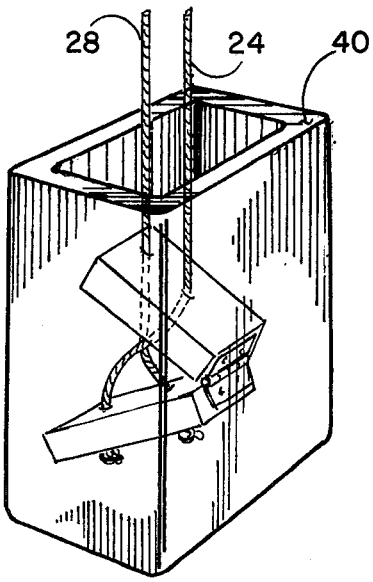
FIG. 3 illustrates the device of this invention shown in a flue liner pipe in a wedged-in position.

In practice as illustrated in FIG. 3, one lowers the device of this invention into chimney flue liner pipe 40 by holding release rope 28. Once the device is inserted within the flue liner pipe 40, one pulls on lowering rope 24 which raises wedge element 10 to a more horizontal position thereby wedging it and portions of release element 12 against opposing sides of the flue liner pipe. It should be noted that the length of wedge element 10 must be sufficient so that the device makes contact on opposing sides in order for frictional adhesion to occur by the wedging of wedge element 10 within the pipe. When the device of this invention is wedged in the pipe, one can raise and lower the pipe into position down the top of the chimney as seen in FIG. 2.

Lowering rope 24 and release rope 28 used in the device of this invention can be rope of sufficient strength to hold the chimney flue liner pipe once it is elevated off the ground. Rope such as manila, sisal, or rope made of synthetic nylon polypropelene or any equivalent material can be used. Wedge element 10 and release element 12 can be constructed of wood, or any other strong hard material such as plastic, metal or any equivalent thereof. Hinge member 14 can be composed of metal and be similar in construction to that of a door hinge, but can also have any other equivalent construction or equivalent hinge means between the two elements.

Although the present invention has been described with reference to particular embodiments, it will be apparent to those skilled in the art that variations and modifications can be substituted therefor without departing from the principles and spirit of the invention.

I claim:

1. A device for the raising and lowering of a chimney flue liner pipe within a chimney comprised of:

a wedge element having a wedge element rope aperture defined centrally therein and a wedge element lowering rope aperture defined toward one end of said wedge element;

a release element having a release element lowering rope aperture defined centrally therein and a release element release rope aperture defined toward one end of said release element;

a lowering rope which passes through said release element lowering rope aperture of said release element and through said wedge element lowering rope aperture of said wedge element and is fastened to said wedge element by fastening means;

a release rope passing through said release element release rope aperture of said release element and through said wedge element release rope aperture of said wedge element and is fastened to said wedge element by fastening means; and a hinge member affixed to said wedge element at its end opposite to said wedge element lowering rope aperture of said wedge element, and affixed to said release element at its end opposite to said release element release rope aperture of said release element.

2. The device as recited in claim 1 wherein said release element and said wedge element are rectangular in shape.

3. The device as recited in claim 2 wherein said wedge element and said release element are of sufficient length to be wedged within said chimney flue liner pipe to be utilized in lining said chimney.

4. The device as recited in claim 1 wherein said fastening means are knots tied in said lowering rop and said release rope.

* * * * *